US007441491B2

(12) United States Patent
Snow

(10) Patent No.: US 7,441,491 B2
(45) Date of Patent: Oct. 28, 2008

(54) DRUM MAGAZINE FOR FIREARM

(75) Inventor: Michael Raymond Snow, Charlottesville, VA (US)

(73) Assignee: Annatac Industries, Incorporated, Lyndhurst, VA (US)

( * ) Notice: Subject to any disclaimer, the term of this patent is extended or adjusted under 35 U.S.C. 154(b) by 281 days.

(21) Appl. No.: 11/273,994

(22) Filed: Nov. 14, 2005

(65) Prior Publication Data

US 2007/0107592 A1 May 17, 2007

(51) Int. Cl.
*F41A 9/26* (2006.01)

(52) U.S. Cl. ..... 89/33.02; 42/19; 42/1.02

(58) Field of Classification Search ..... 89/33.02; 42/19, 1.02

See application file for complete search history.

(56) References Cited

U.S. PATENT DOCUMENTS 1,332,936 A * 3/1920 Veeder ..... 89/33.02
2,161,696 A * 6/1939 Blacker ..... 42/49.01
4,384,508 A * 5/1983 Sullivan et al. ..... 89/33.02
4,487,103 A * 12/1984 Atchisson ..... 89/33.02
4,658,700 A * 4/1987 Sullivan ..... 89/33.02

* cited by examiner

*Primary Examiner*—Stephen M Johnson
(74) *Attorney, Agent, or Firm*—Langlotz Patent Works, Inc.; Bennet K. Langlotz

(57) ABSTRACT

A detachable magazine for storing and delivering ammunition to a firearm having a magazine well. The magazine has a body with a column adapted for insertion into the magazine well. The column has a passage for transmitting ammunition to the firearm. The body includes a drum housing defining a substantially cylindrical chamber communicating with the column passage. A first sprocket element is rotatably received in the chamber and has a serrated periphery, with each serration adapted to receive an ammunition cartridge. A second sprocket element is rotatably received in the chamber, and is concentric with the first sprocket element, having a serrated periphery with each serration adapted to receive an ammunition cartridge. A spring element is connected to at least one of the sprocket elements, and operates to rotatably bias the sprocket elements to transmit cartridges from the drum chamber to the column passage. The magazine may have a pair of drums, and the sprockets may be tapered, to facilitate feeding of tapered cartridges. The magazine may include a counter to indicate the quantity of ammunition consumed or remaining. The magazine may include the ability to power and de-power spring motor.

25 Claims, 10 Drawing Sheets

104
102
104'
102'

104
92
94
102
3A
112
110
106
70
90
74
76
116
114
121
120
62
26
045
52
122
126
62
30
124
70
42
46
44

DRUM MAGAZINE FOR FIREARM

FIELD OF THE INVENTION

This invention relates to the devices for storing and feeding ammunition to a rifle or machine gun, and more particularly to devices having round storage chambers.

BACKGROUND AND SUMMARY OF THE INVENTION

Military rifles and machine guns are capable of consuming large quantities of ammunition in a short time, and it is desirable to supply these quantities to the rifle without frequent interruptions for reloading. There have been many attempts to provide military forces with a small arms improvement for an advantage in combat. High capacity firing devices provide a dominant support tool in the battlefield. There is a significant need for our military to have the option of a device that can reliably provide a 150-round capacity to all of the weaponry firing from a NATO standard, STANAG 4179, magazine. Belt-fed machine guns are effective for sustained fire without reloading, except that a belt-fed machine gun is by nature a more complicated and heavy system because of the additional apparatus required to move the belt, extract the rounds from the belt, and chamber the cartridge. This is in addition to the weight of the apparatus attached to the gun to hold the ammunition belt and the steel links holding the belt together.

A more modern machine gun capable of feeding both belts and magazines performs less reliably than a gun optimized for one or the other. This is because of the different dynamics when feeding a cartridge from a simple magazine compared to the tension required to draw in a belt. A significant tension is required to lift the long belt the pitch distance of the rounds in the belt, and to strip the cartridge from the link to which is holding it. This performance difference is most easily noticed by the increase in recoil and cycle rate when firing from the magazine in a rifle optimized with adequate cyclic energy to feed a belt.

Belts can become dirty or angled in the field, leading to malfunctions. Typical stick or box magazines having 20-40 cartridges in a vertical stack, typically two columns side-by-side, are more protective of the ammunition, but require much more frequent interruptions for extraction of the spent magazine and insertion of a fresh magazine. These can be depleted after as little as two seconds of sustained firing. Conventional magazines have a spring located in the bottom of the magazine. This spring must have enough force to efficiently force the last round into the feeding position in the short time allowed, even when the spring is in its most relaxed condition. This causes the spring to be larger if there is more ammunition to be lifted. This compounds the problem with vertical height issues as it is of key importance that the shooter remain as low as possible when in combat. Longer stick magazines can provide greater capacity, except that the added length forces a prone shooter to hold the rifle higher above the ground, making him more vulnerable to enemy fire.

Drum magazines such as employed in the Thompson submachine gun, store cartridges in a cylindrical body that permits a larger capacity. The Thompson gun lacks a protected magazine well, so that the periphery of an installed drum is nearly coincident with the firearm bore and allows the cartridges to be easily picked from the drum and directly inserted into the chamber. The cartridges were contained within a spiral and were pushed along the spiral path until exiting the opening at the top of the drum. It was found that this system could reliably feed only about 50 rounds before the friction drag from the cartridges against the spiral would result in failures. It was also deemed difficult because the re-loading process required that the drum be opened and ammunition be placed into separate loading channels.

A dual drum magazine, such as disclosed in U.S. Pat. No. 4,658,700 to Sullivan, provides substantial capacity (upwards of 100 cartridges, depending on caliber) without significant height by positioning one drum one on each side of a central column. The column is essentially the upper portion of a stick magazine that inserts into a rifle's magazine well, with the drums on either side feeding the column. The inside stack of cartridges in each drum is driven by a sprocket, the outside row of cartridges is driven by the inside row of cartridges. This creates great fictional forces against the wall because of the cartridge to cartridge contact causes an outward push along with the rotational force driving the second row of cartridges. This is compounded when the double row of cartridges, of which only one has direct power and the other is powered by path of least resistance, try to leave the drum and are driven by a cam blade into a single stack. The cartridges then change direction by 90 degrees and join in a parallel stack. For reliability of feeding, it is desirable to have a very strong force, which is readily achieved when the magazine is full and the feed springs fully compressed, but more critical when the last rounds are being fed. Because of high friction drag design, introduction of dirt or dust may increase friction to unacceptable levels, and impair reliable feeding. Moreover, loading of the magazine is difficult as it becomes full, due to the force of the feed springs that resist cartridge insertion. This also may cause failures of speed loader devices.

Another drum magazine is disclosed in U.S. Pat. No. 4,384,508 to Sullivan et. al, which employs a single drum and a sprocket feed system, and is incorporated herein by reference. A set or series of concentric sprockets each carry a single ring of cartridges, and rotate independently to provide lower friction feeding of one ring of cartridges at a time. This system allows the cartridges to be individually nested with less overall friction and free from significant drag until picked from the sprocket. This was designed in conjunction with the firearm for which it was to operate. Consequently, this firearm has no supportive magazine well. The drum diameter is nearly coincident with the firearm bore and allows the cartridges to be easily picked from the drum and directly inserted into the chamber. This feeds the cartridges outward at a port that extends radially, not tangentially from the cylindrical outer wall, and is unsuitable for use with magazine-fed rifles due to the inadequate column length, and the substantial downward extension that magazine would present. A major problem with this system is that it was powered by a strong spring that is difficult to counter during reloading. While internally effective with certain limitations, it is suited for rifles specially built to accommodate it, and not for rifles with magazine wells that are designed to protect the conventional stick magazines that they are designed to accept.

The present invention overcomes the limitations of the prior art by providing a detachable magazine for storing and delivering ammunition to a firearm having a magazine well. The magazine has a body with a column adapted for insertion into the magazine well. The column has a passage for transmitting ammunition to the firearm. The body includes a drum housing defining a substantially cylindrical chamber communicating with the column passage. A first sprocket element is rotatably received in the chamber and has a serrated periphery, with each serration adapted to receive an ammunition cartridge. A second sprocket element is rotatably received in the chamber, and is concentric with the first sprocket element, having a serrated periphery with each serration adapted to receive an ammunition cartridge. A spring element is connected to at least one of the sprocket elements, and operates to rotatably bias the sprocket elements to transmit cartridges from the drum chamber to the column passage. The magazine may have a pair of drums, and the sprockets may be tapered, to facilitate feeding of tapered cartridges. The magazine may include a counter to indicate the quantity of ammunition consumed or remaining. The magazine may include the ability to power and de-power spring motor.

DETAILED DESCRIPTION OF A PREFERRED EMBODIMENT

Figure 1:
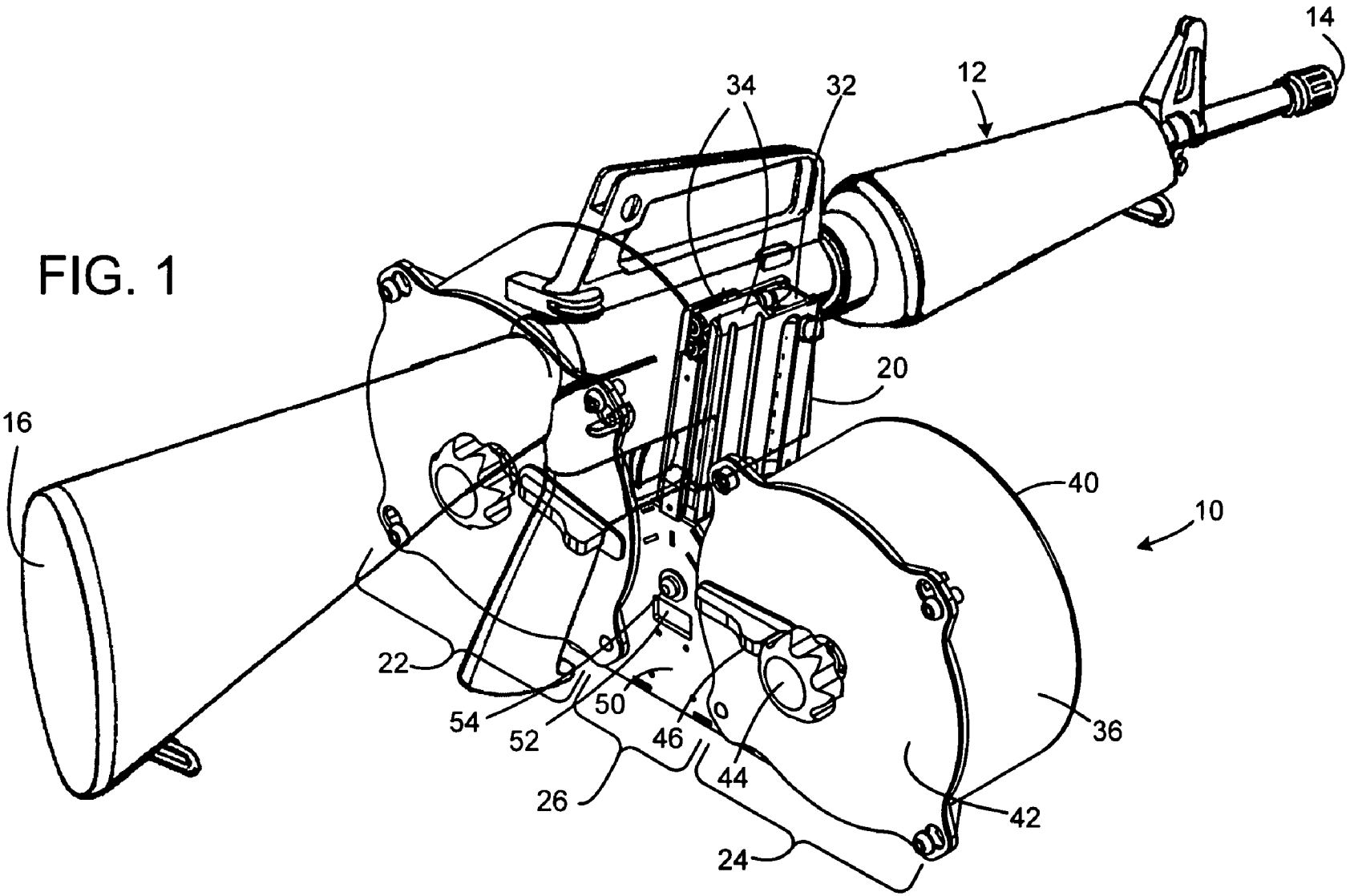
FIG. 1 is a perspective view of a preferred embodiment of the invention installed in a rifle.

FIG. 1 shows a dual-drum magazine 10 as attached to a rifle 12. The rifle has a barrel with a muzzle end 14 extending in a forward direction and a stock end 16 extending in a rearward direction. The rifle has a magazine well 20 that extends downward from an intermediate portion of the rifle, defining a channel with a rectangular cross section. A bolt reciprocates within the rifle above the magazine well, to strip ammunition rounds from the magazine and to chamber them for firing.

In the illustrated embodiment, the rifle is an M16, M4, or AR15. However, in alternative embodiments, the rifle may be of any type capable of accepting a detachable magazine. The preferred embodiment is illustrated as an example using 5.56 mm NATO cartridges, but any bottlenecked rifle cartridge or straight-walled pistol cartridge may be accommodated by the invention, as modified to adjust dimensions as needed. The 5.56 mm cartridge is a bottlenecked cartridge having a base, a nearly cylindrical body extending from the base, a frustoconical shoulder that tapers to a smaller diameter neck with a mouth that receives a bullet. The nearly cylindrical body, like most rifle and pistol cartridges, is slightly tapered, so that the casing may readily be extracted from the chamber after firing. In the 5.56 mm cartridge, this portion has an included taper angle of about 1 degree. Accordingly, conventional box magazines that hold a stack of closely packed cartridges must have a slight curve or bend to allow for the increased length of the stack at the bases of the cartridges compared to at the front ends of the bodies near the cartridge shoulder.

The magazine 10 has the form of a pair of generally cylindrical drums 22 (left) and 24 (right), with the axes defined by the drums extending substantially horizontally, nearly parallel to the axis of the rifle barrel, except for a slight upward tilt as will be discussed below. The drums are spaced apart, and connected to each other by a central portion 26. A column portion 30 extends nearly vertically from the central portion, and has the form of the upper portion of a conventional M16 box magazine capable of carrying a double stack of cartridges in the conduit or passage defined within. An upper aperture 32 provides for the rounds to be transmitted to the rifle's action, and a pair of feed lips 34 retain the cartridges until stripped by the bolt in the rifle.

Each drum of the magazine is formed by a cylindrical sidewall 36, a front panel 40, and a rear panel 42. A spring winding knob 44 (which could be any winding mechanism such as a flip out crank arm) is centered on each rear panel, and an adjacent sliding winder latch 46 is also on the rear panel to lock the spring motor torque. In alternative embodiments, locking of the ratchet can be done in many ways, the ratchet and hub could also be locked to the inside spindle on which the whole drum rotates.

The central portion 26 provides a rigid connection between the drums, and a support for the column 30. A rear panel 50 defines an aperture for viewing an electronic counter display 52 that displays a count of rounds passing through during loading or feeding, and which is connected to circuitry contained in the central portion. A reset button 54 is also connected to the circuitry to zero the counter as needed.

Figure 2A:
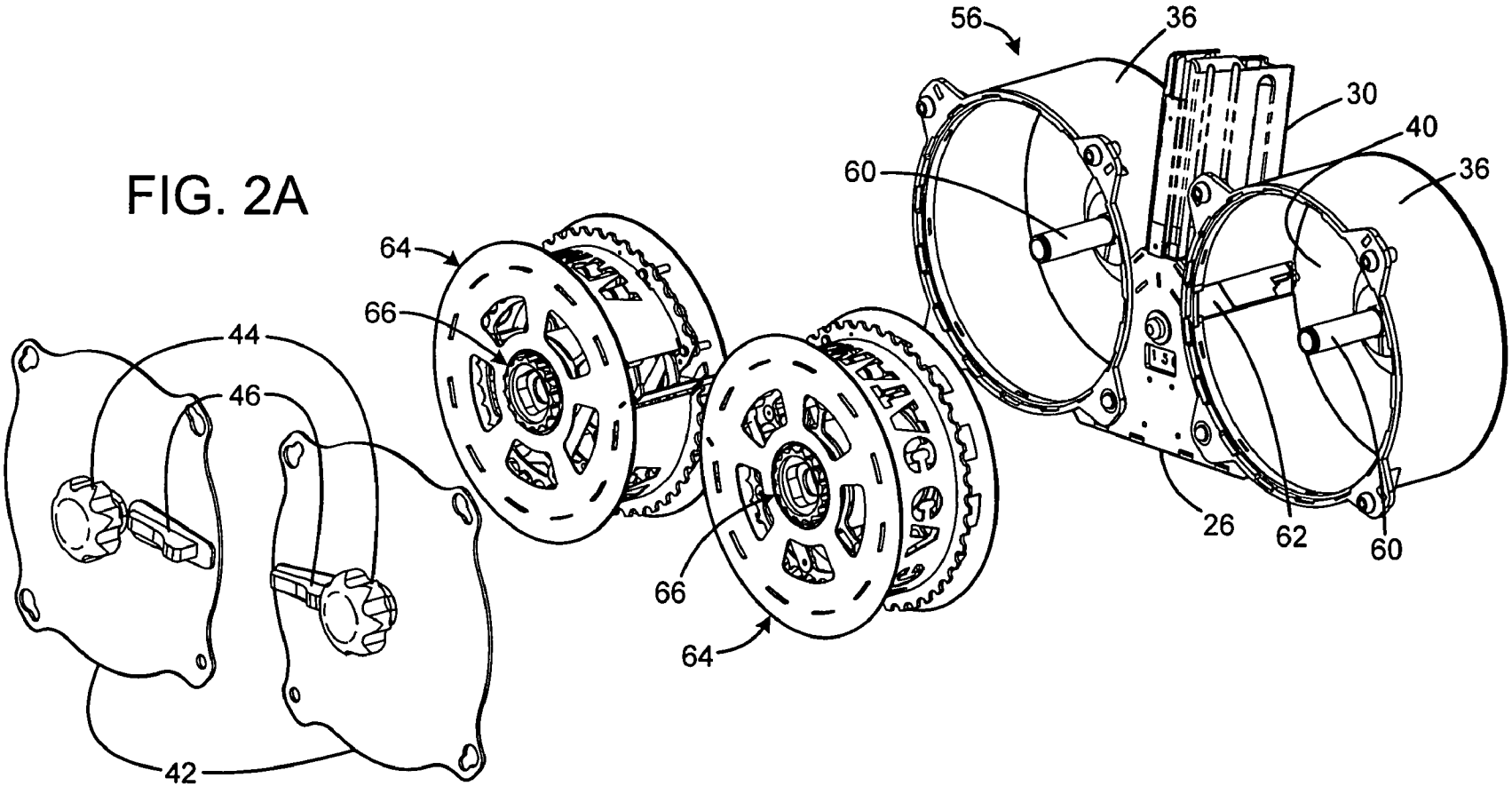
FIG. 2A is an exploded view of the embodiment of FIG. 1.

As shown in FIG. 2A, the magazine has a main housing assembly 56 formed of the front panel 40, sidewalls 36, and central portion 26. As shown, each sidewall has a central spindle 60 centered in each cylindrical chamber. The spindles are rotatably secured to the rear panels. The sidewalls each define a gap 62 extending the length of the sidewall, and providing a passage into the central portion. The gaps 62 approximately face each other, and are nearly on a line connecting the drum axles. Essentially, they are at the 3:00 and 9:00 positions when viewed from the shooter's perspective at the rear.

A spool 64 is received in each drum. The spools have central apertures that receive the spindle, and are discussed in detail below. The front plates 40 enclose the spools in the housing.

A ratchet plate 66 is secured to the spindle to permanently rotate therewith. As will be discussed below, a flat coiled spiral spring is selectably engaged to the spindle and to the spool. This allows the spring to store energy and provide a biasing force in response to rotation of the spool from a home position. However, the spring may be disengaged to allow the spool to be loaded with cartridges and go thorough two rotations without encountering spring resistance that would make re-loading difficult. Thus, the spring is disengaged while the magazine is loaded. After the magazine is loaded, the knob 44, which is connected to the spindle and ratchet, is turned to load the spring, which has an inner end connected to the spindle. Each knob is been rotated through at least two rotations (more, to provide substantial biasing force for the last round to be fed to the rifle after the spool has completed two rotations). Then, the associated sliding latch 46 is moved so that pawl of the latch interferes with a tooth on the ratchet to keep the spring from unwinding. Motion of the pawl is preferably provided by spring biasing the slider into the engaged position, so that during winding of the spring, the pawl cams over the sloped portions of the ratchet, and secure it against unwinding whenever the knob is released. This can be done many different ways as someone skilled in the art could deduce. A catch mechanism preferably holds the latch in a released position during loading, so that the ratchet may rotate as the sprockets rotate without engaging the pawl to tension the spring.

Figure 2B:
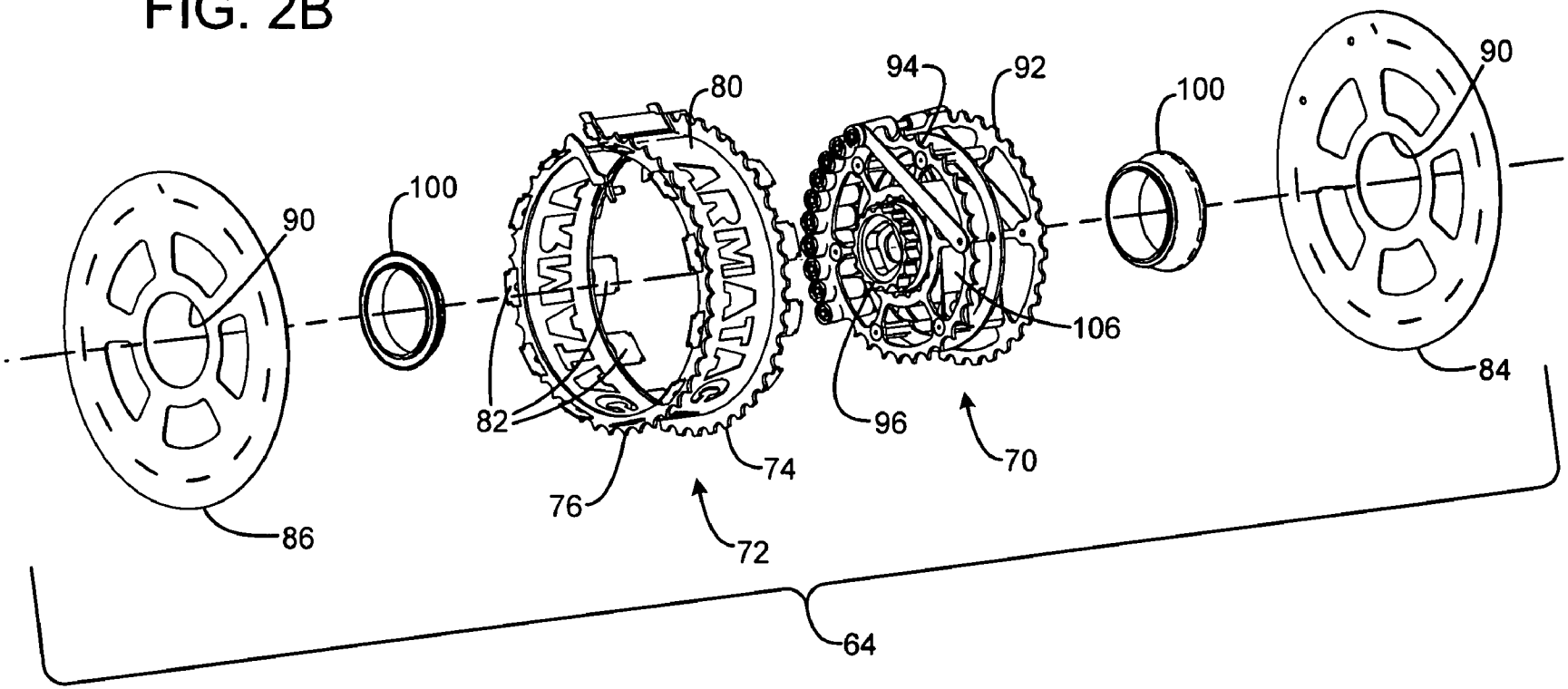
FIG. 2B is an exploded view of an internal component.

FIG. 2B shows an exploded view of one of the spools. The primary operational elements of the spool are an inner sprocket assembly 70 and outer sprocket assembly 72. The outer assembly has the form of a cylindrical band, with a front sprocket plate element 74 and a rear sprocket plate element 76 with serrated peripheries, and connected to each other by a cylindrical band 80, but which is preferably skeletal for weight reduction. The front and back sprockets have intermittent slits cut in a circle, and tabs 82 penetrate the slits to secure the assembly as a unit, such as by welding. A front plate 84 and a rear plate 86 have similar slits that enclose the spindle on each face of the outer sprocket element. The front and rear plates each define central apertures 90.

The inner sprocket assembly 70 has a front sprocket plate element 92 and a rear sprocket plate element 94 that have serrated peripheries, and skeletal inner portions connected to a cylindrical hub 96. The hub is sized to be rotatably received in the plate apertures 90, so that the inner sprocket element can rotate with respect to the outer element.

Several PTFE spacers or bushings 100 are attached to the end plates 84, 86 to limit rotational friction of the spool in the drum and to limit rotational friction of the inner sprocket assembly within the outer assembly.

Figures 3, 3A:
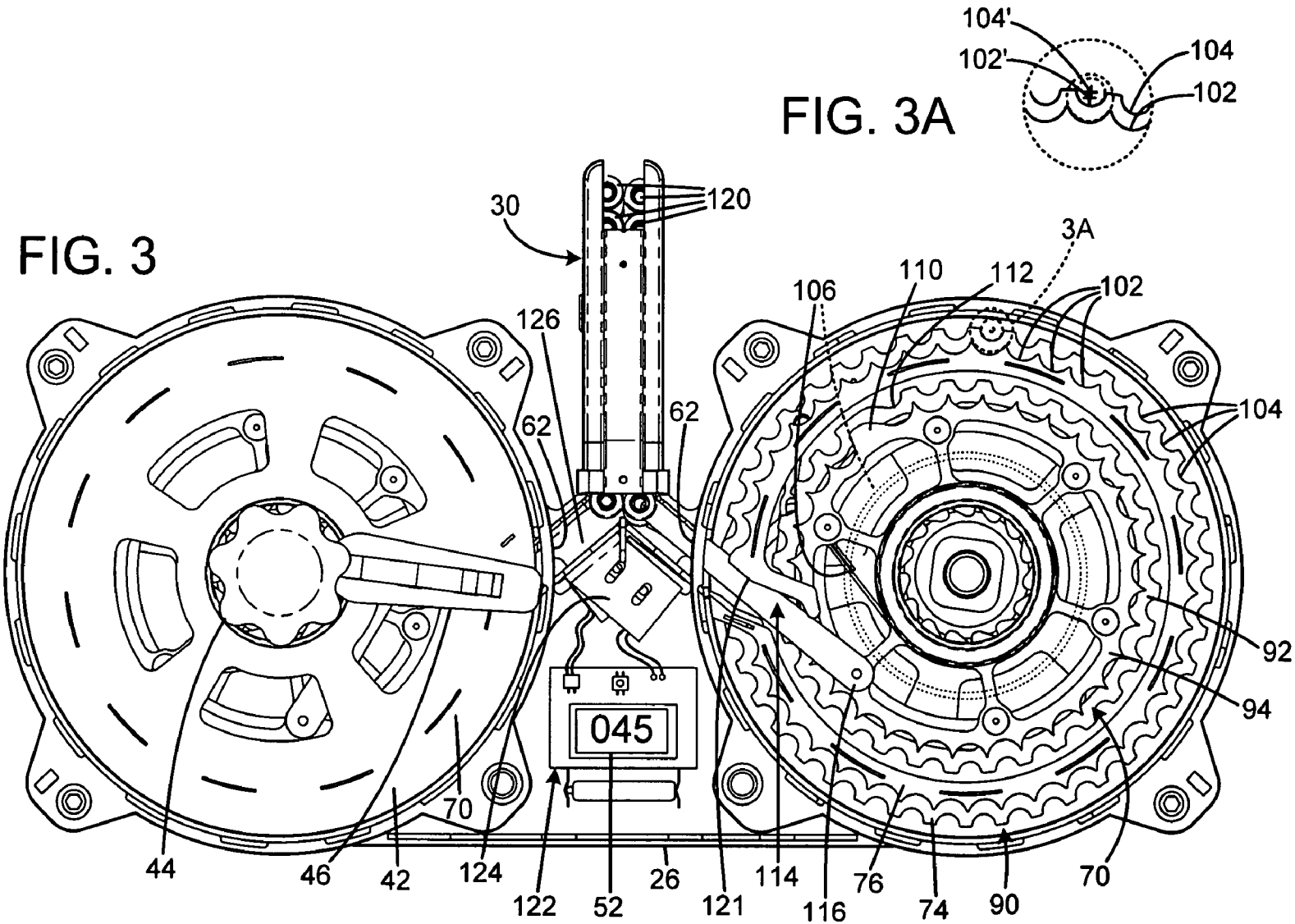
FIG. 3 is a cutaway rear view of the embodiment of FIG. 1 in an unloaded condition.
FIG. 3A is an enlarged view of a portion of the embodiment of FIG. 1.

FIG. 3 shows a rear view of the magazine, with the right rear cover 42 and plate 86 removed. This shows the configurations of the serrations of the sprocket plates. For a 5.56 mm NATO cartridge, the serrations 102 of the rear plate are arcs with a radius of 0.1875 inch, to fit the case body near the base of the case. The serrations 104 of the front plates are arcs with a radius of 0.125 inch, to fit the diameter of the case neck just forward of the shoulder. Each sprocket plate of each assembly has the serrations arranged in a circle centered on the spindle axis, with the centers of the serrations forming a circle of a selected radius from the spindle center.

As further shown in FIG. 3A, the centers 104' of the serrations 104 of the front plate are positioned at a slightly greater radius from the drum center than the centers 102' of the rear serrations 102. This causes the cartridges to be stored slightly "tips out", so that axes defining the centers of each round converge to the rear, and so that the case bodies are nearly adjacent or abutting at the rear of the cartridges, and slightly spaced apart near the shoulders, even more than would be expected due to the taper of the case body. This has an advantage for reliable cartridge feeding and housing geometry when cartridges exit the drums to the center portion, so that they arrive at the base of the column in alignment with the column, and without yaw. In the preferred embodiment, the radius of the inner sprocket front plate serration centers is 2.12 inch, and the radius of the inner rear plate serration centers is 2.0 inch, a slight difference of 0.12 inch. This similar difference applies to the outer sprockets, where the radii are 2.69 and 2.6 inch, respectively. There is a gap between the inner sprockets of 1.25 inch; the gap for the outer sprockets is 1.5"

The coiled drive spring 106 has an outer end connected to the inner sprocket element, and is wrapped about the spindle, attached to the spindle at the inner end. When cranked by the knob to provide biasing torque, the spring coils expand outward to the position show in dashed lines within the inner sprocket. In alternative embodiments, the spring could also be the exact opposite, in that could be naturally swelled radially when at rest, and when charged it contracts to the inner diameter. When fully cranked outward, further cranking provides a positive torque on the sprocket, so that a jam or malfunction can be cleared by forcing stuck rounds out of the magazine.

The inner sprocket element 70 has 31 serrations. A solid tab element 110 is the only interruption of the even array of serrations. This tab is for the arc clearance the follower 114 and dummy must have. The first serration 112 in the clockwise direction of the tab (right drum, as viewed from the rear—the left drum is mirror image in all respects) is the space into which the crank arm's attached cartridge is received.

A crank arm 114 is pivotally attached to the inner element 70 at a first end 116, and extends out of the drum aperture 62 to the base of the column, where it is attached to a linked group of dummy rounds 120, which may be about 8 to 10 in the preferred embodiment. When the magazine is empty as shown, the groups (one from each drum) fill the column, so that they support the first rounds loaded into the magazine. When the magazine is nearly depleted after firing, and is feeding the last rounds to the rifle, the linked dummy rounds transmit the sprocket torque to assist in feeding the final cartridges from the magazine. As the magazine fills, the dummy rounds occupy the first spaces in the inner sprocket. The outer sprocket has an opening 121 through which the rounds pass as the inner sprocket element is fed with rounds during loading, as will be discussed below.

The magazine includes a shot counter system 122 including the display 52, and circuitry, battery, and contact switches 124 that have contact elements adjacent to the paths followed by the cartridges, so that they can send a signal to the circuitry when a cartridge passes, either during loading or feeding. A memory in the counter increments upward as a round passes during loading, and during feeding. This may be achieved by a contact switch that detects the passage of the rounds. The external switch may be used to "zero" the counter after the magazine has been loaded and emptied, so that rounds fired cause the counter to increment.

The center portion of the magazine has an inverted Y-shaped passage that has two diagonal channels 126 that extend medially and upward from the drum openings 62 at an approximate 90 degree angle relative to each other. The channels converge directly below the lower end of the column 30, so that a single row of cartridges passes through each channel, and the column contains a double stack of cartridges. A short medial divider causes the rounds to travel vertically before merging them into their side by side stack.

Figure 4:
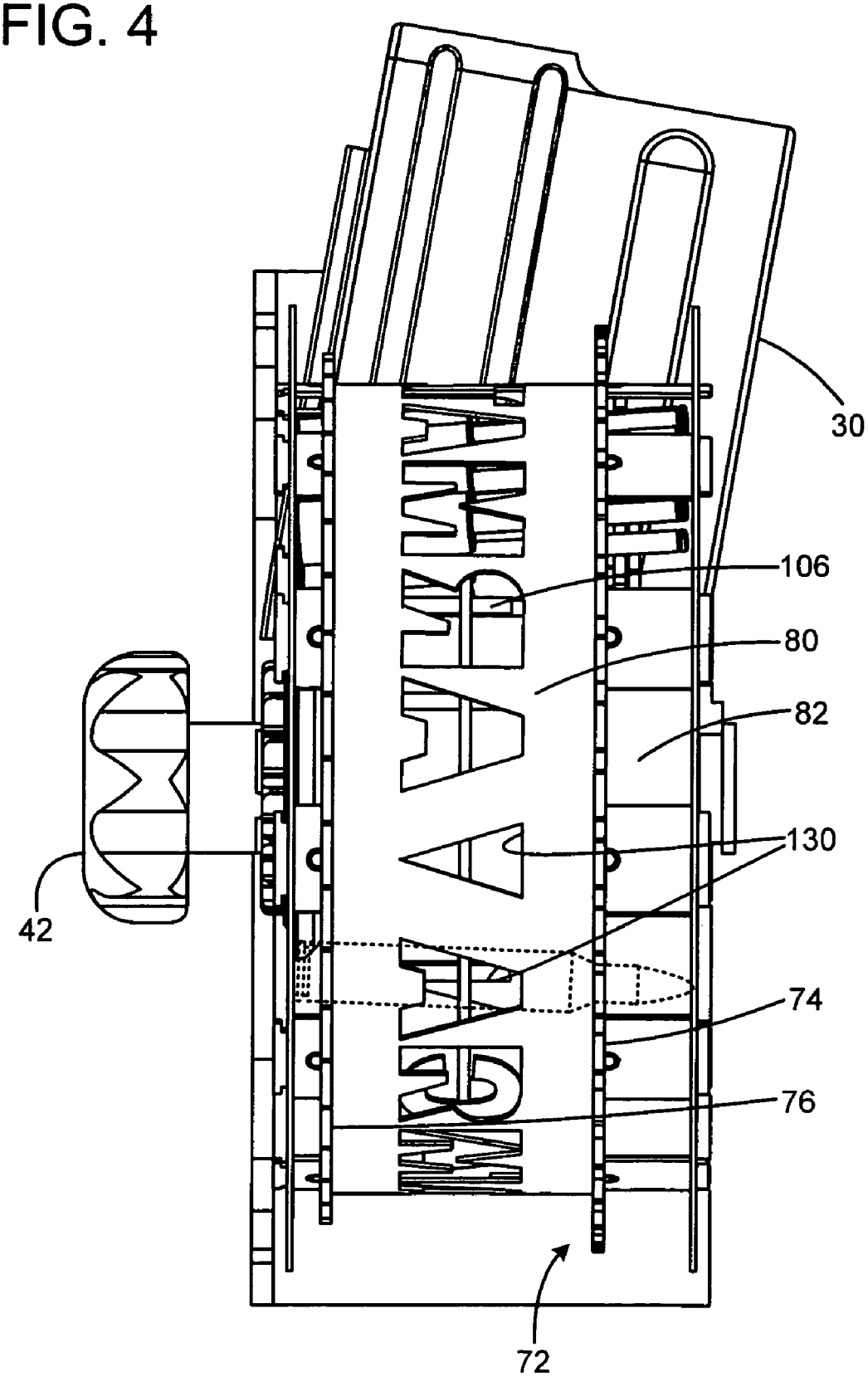
FIG. 4 is a cutaway side view of the embodiment of FIG. 1 in an unloaded condition.

FIG. 4 shows a side view of the magazine, with portions of the housing removed for illustration. The band 80 of the outer sprocket element is shown with weight reducing apertures 130 to provide a skeletal structure. The drum is canted with respect to the column 30, so that the accumulated taper angle of the cartridges in the column is accounted for. This ensures that cartridges exiting the drum are aligned with the stack at the bottom of the column that they are about to enter. Without this cant angle (10 degrees in the preferred embodiment), the spring force transmitted from the drum, up the stack of cartridges in the column, would bias only the bases of the cartridges against the feed lips at the top of the column, and the forward end of the top cartridge would angle downward below the opening at the top of the column, preventing it from being stripped from the magazine by the rifle bolt.

Figure 5A:
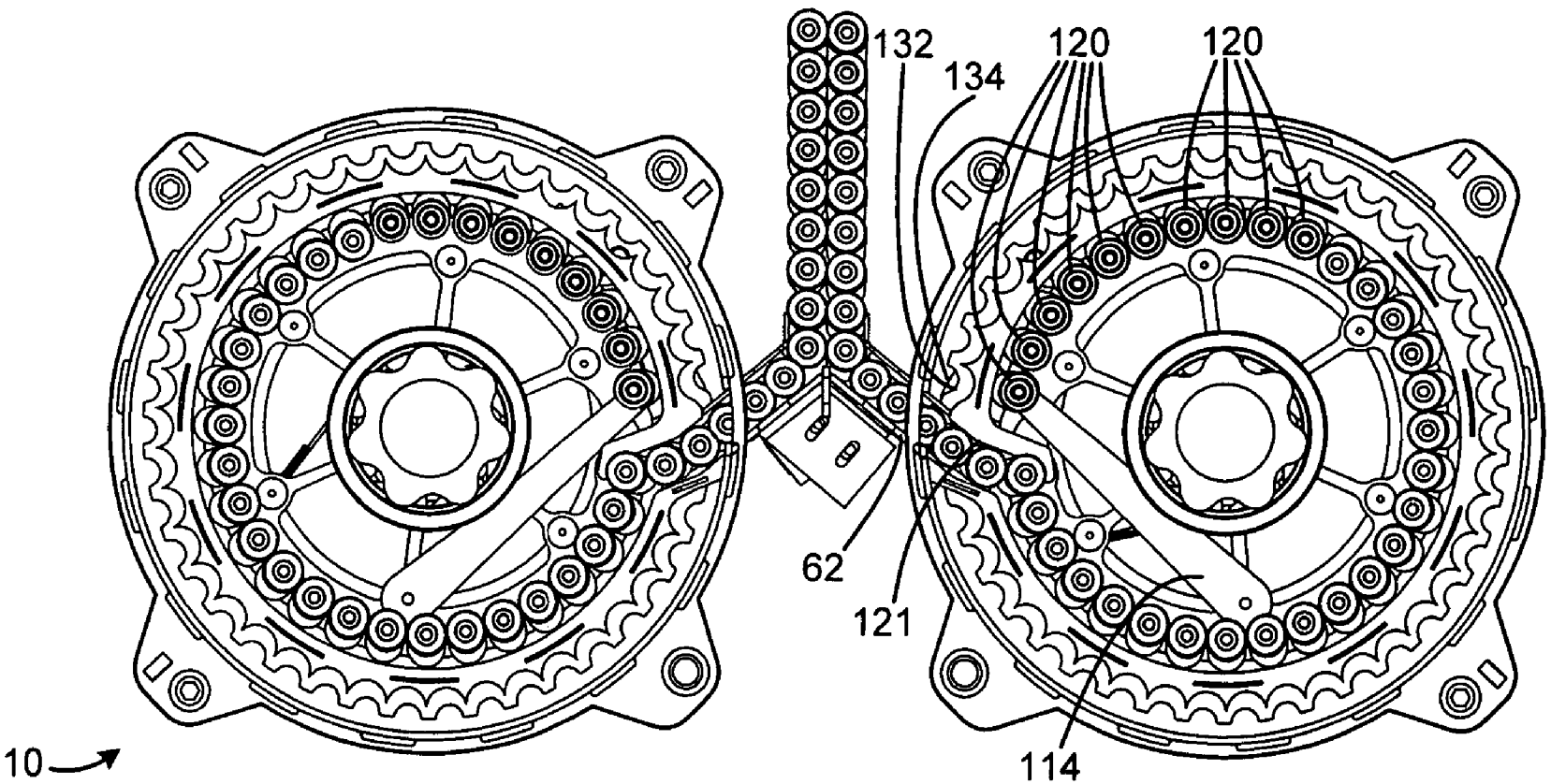
FIG. 5A is a cutaway rear view of the embodiment of FIG. 1 in a partially loaded condition.

FIG. 5A shows the magazine 10 in a partially loaded condition. The inner sprocket assembly has been loaded with cartridges by rotating, while the outer assembly has remained stationary to keep the outer gate 121 in line with the housing opening. The first several spaces are occupied by the dummy rounds 120, and the arm 114 is pivoted so that it resides within the circumference of the inner assembly.

At this point, additional cartridges and further charging will cause the inner assembly to engage with the outer assembly, and they will rotate together as the serrations on the outer sprocket are filled. With the channel 121 filled with cartridges, the next cartridge will occupy the first serration 132 of the outer sprocket assembly. This is the first in the clockwise direction from the channel 121. The first serration has an associated disconnector actuator element 134 that is spring biased to the position shown, to partially occupy the serration space.

Figure 5B:
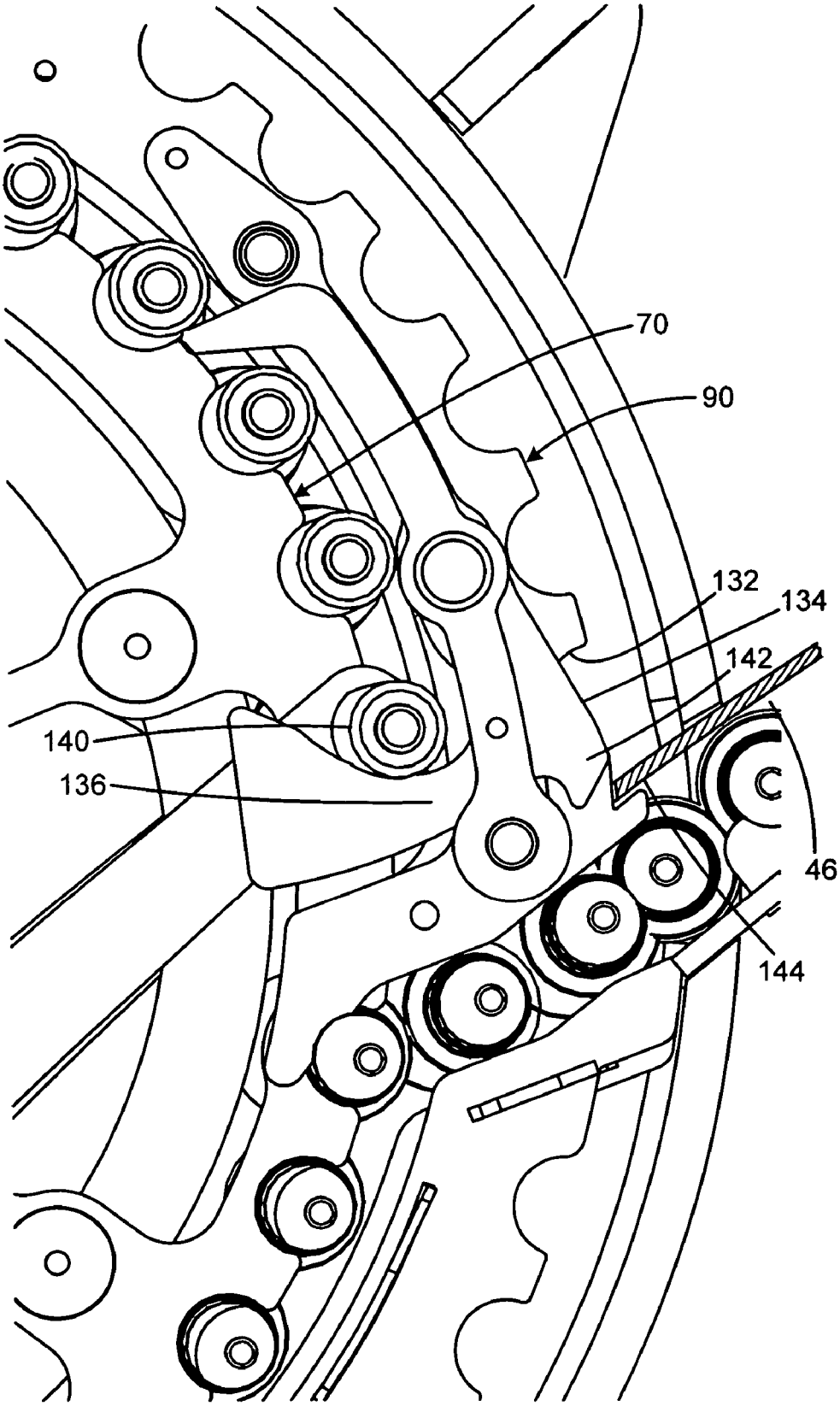
FIG. 5B is an enlarged cutaway front view of the embodiment of FIG. 1 in a partially loaded condition.
Figure 6A:
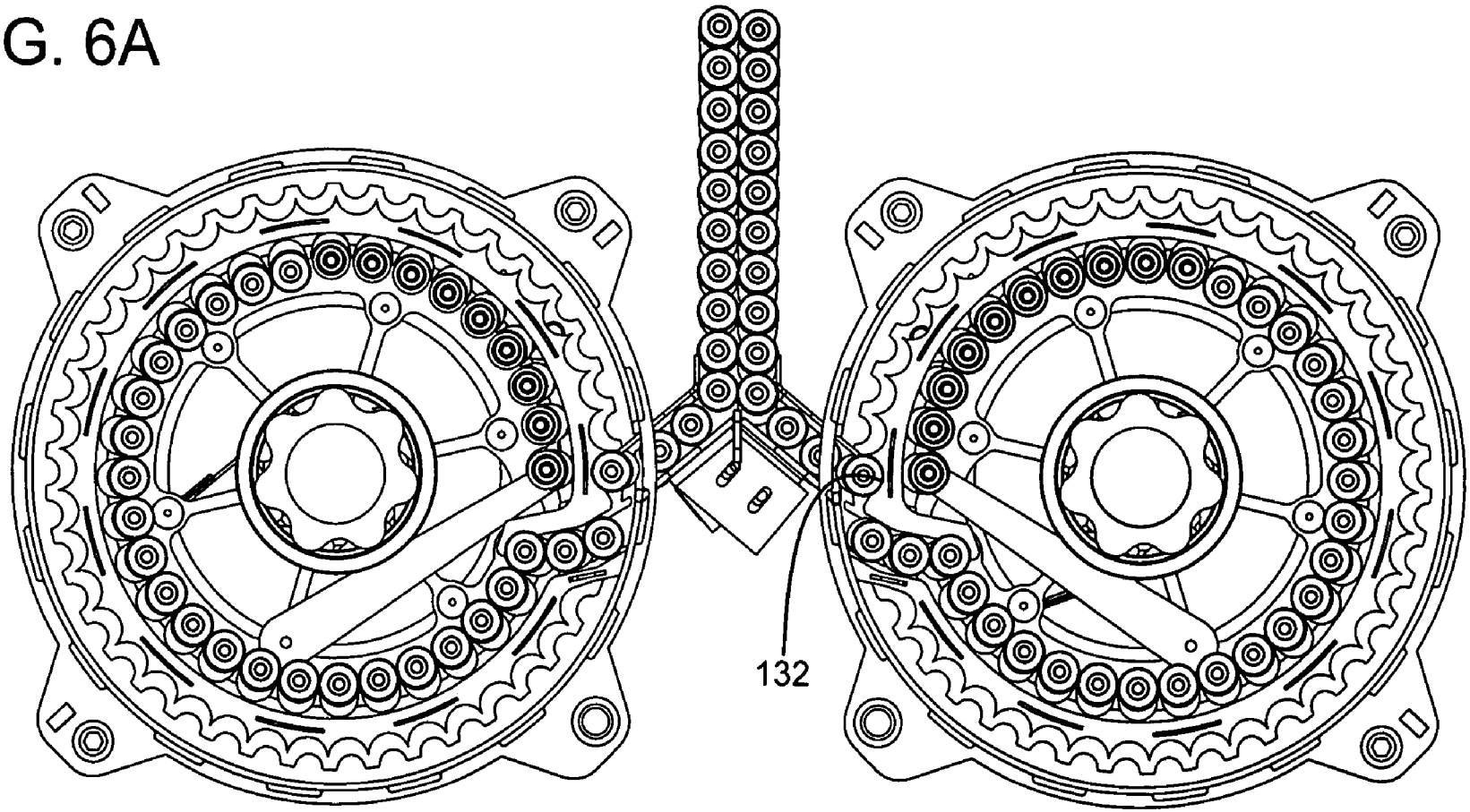
FIG. 6A is a cutaway rear view of the embodiment of FIG. 1 in a further partially loaded condition.
Figure 6B:
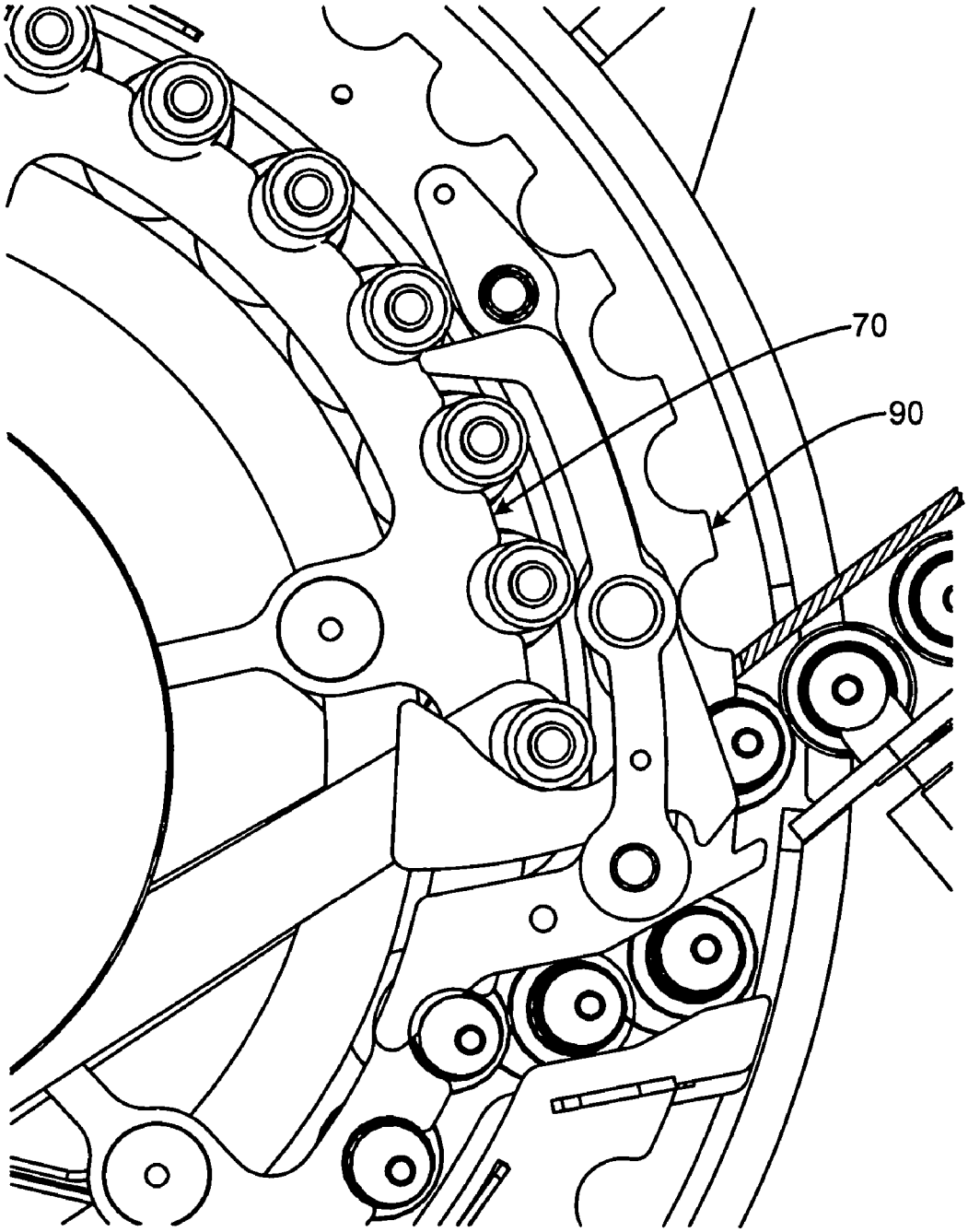
FIG. 6B is an enlarged cutaway front view of the embodiment of FIG. 1 in a further partially loaded condition.
Figure 7:
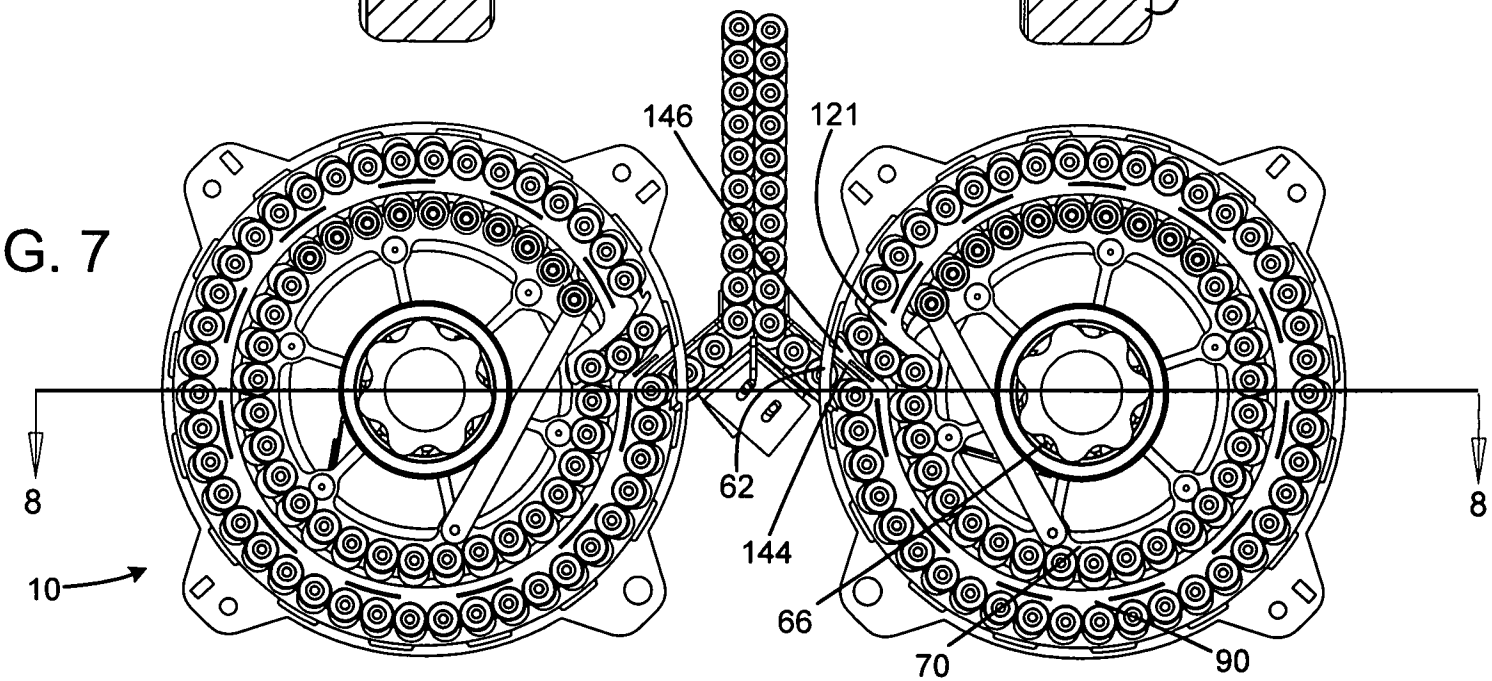
FIG. 7 is a cutaway rear view of the embodiment of FIG. 1 in a fully loaded condition.

FIG. 5B shows the front view of the disconnector 134 in the lowered position. The disconnector has a lower leg 136 that has a sloped surface that is engaged by the first (dummy) cartridge 140 when the inner sprocket assembly is fully rotated and filled in the illustrated position. Before this engagement lowers the disconnector, a nose portion 142 of the disconnector disengages a housing guide flange 144 that forms the upper wall of the channel 46. FIGS. 6A and 6B show the sprocket rotated by the addition of one more round, which occupies the serration 132 to secure the disconnector in the lowered position. The tip of the lower portion of the disconnector locks the inner sprocket to the outer sprocket via interference with the dummy cartridge FIG. 7 shows the magazine fully loaded. The outer sprocket element has fully rotated, and all serrations are filled with cartridges. Rotation of the outer element is stopped just before the gate opening 121 reaches the housing aperture 62. A stop element 146 forming the counterclockwise side of the gate 121 extends beyond the cartridges, and encounters the flange 144 to limit rotation. At this point, the magazine is full, with 150 rounds being contained (in addition to the dummy rounds.)

To charge the springs, the slider latches 46 are slid to an engaged position, so that the pawls engage the respective ratchets 66. The knobs are rotated in the direction the sprockets rotate during feeding to bias the internal spring, unwinding it from the centrally coiled initial condition at rest, to a strained expanded position in large coils against the interior of the inner sprocket assembly. At this point, the spring will expand no further due to physical limitations, and the operator receives the positive feedback of a hard "stop" against further winding. After some rounds have been fed to the rifle for firing, a partially empty magazine may be further wound to provide increased feeding force. This may be useful in conditions in which dust or other friction-increasing material may have entered the house, to ensure reliable feeding in marginal conditions.

During firing, the loading procedure is reversed, and the rounds are forced out of the magazine under the pressure of the springs. The drum rotates until the outer sprocket assembly is depleted, and the gate aligns with the housing aperture, the disconnector lower tail then releases from a dummy on the inner sprocket and the inner sprocket then rotates alone until depleted, and the dummy rounds reach the top of the magazine column.

Figure 8:
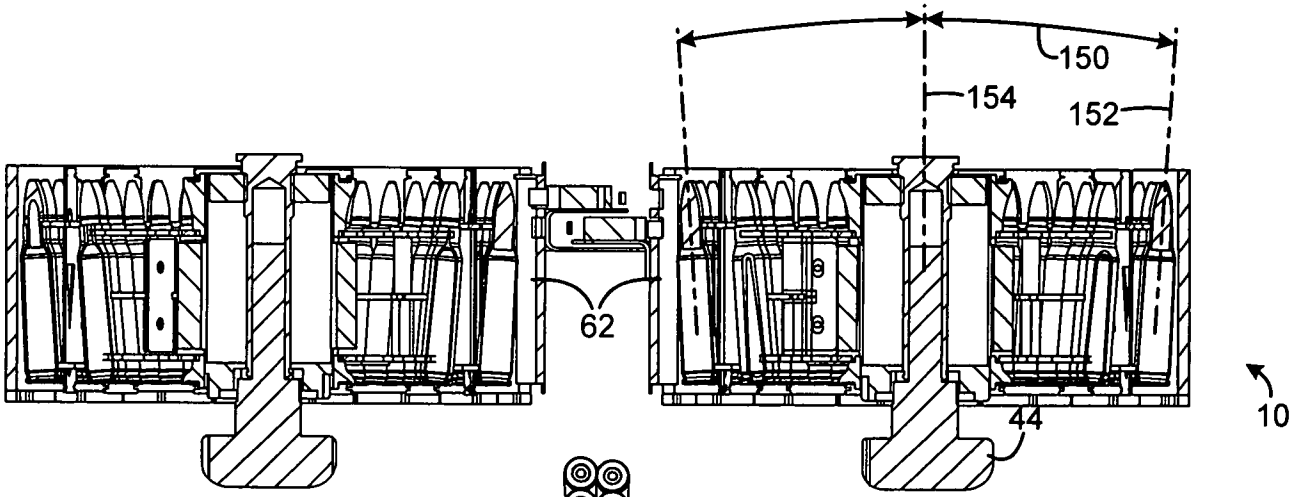
FIG. 8 is a cutaway top view of the embodiment of FIG. 1 in a fully loaded condition, taken along line 8-8 of FIG. 7.

FIG. 8 illustrated the "tips out" configuration of the cartridges in the magazine, as discussed above with respect to FIG. 3. A splay angle 150 of each cartridge axis 152 from the drum axis is provided, based on the taper angle of the cartridge and the number of cartridge between the drum exit and the convergence with the magazine well. In the preferred embodiment, for a cartridge body taper angle of 0.5 degree from the cartridge axis (1.0 degree included), the splay angle is 5.5 degrees for the inner sprocket and 3.5 degrees for the outer sprocket. This allows the 3 or 4 cartridges between the drum aperture and the base of the column to rest against each other's sides, regardless of which sprocket is feeding, providing a smooth transition.

While the above is discussed in terms of preferred and alternative embodiments, the invention is not intended to be so limited.

The invention claimed is:

1. A detachable magazine for storing and delivering ammunition to a firearm having a magazine well, the magazine comprising:

a body having a column adapted for insertion into the magazine well;

the column defining a passage for transmitting ammunition to the firearm;

the column having a width selected to receive a double stack of ammunition;

the body including a drum housing defining a substantially cylindrical chamber communicating with the column passage;

a first sprocket element rotatably received in the chamber and having a serrated periphery with each serration adapted to receive an ammunition cartridge;

a second sprocket element rotatably received in the chamber, and concentric with the first sprocket element, and having a serrated periphery with each serration adapted to receive an ammunition cartridge;

a spring element operably connected to at least one of the sprocket elements, and operable to rotatably bias the sprocket elements to transmit cartridges from the drum chamber to the column passage; and wherein the serrations define centerlines that converge to a common point to the rear of the magazine, such that stored cartridges are arranged with their forward tips splayed outward from an axis defined by the sprocket elements.

2. The magazine of claim 1 wherein the spring is selectably engaged to the sprocket elements, so that the magazine may be loaded without substantial biasing force resisting the loading.

3. The magazine of claim 1 wherein each sprocket element has spaced apart sprocket discs each defining serrations.

4. The magazine of claim 3 wherein one of the discs has a smaller periphery than the other, such that cartridges received in the serrations will define centerlines that are angularly offset from each other.

5. The magazine of claim 4 wherein the serrations of each disc are arcs defining centers, the arc centers of each disc being arrayed in a circle having a selected diameter, the selected diameter for the first disc being smaller than the selected diameter of the second disc.

6. The magazine of claim 5 wherein the arcs of the first disc have a smaller radius than the arcs of the second disc.

7. The magazine of claim 1 including an ammunition counter attached to the body and responsive to the passage of each cartridge, and having an indicator indicating the quantity of cartridges passed.

8. A detachable magazine for storing and delivering ammunition to a firearm, the magazine comprising:

a body having a conduit defining a passage for transmitting ammunition to the firearm;

the body including a first drum housing and a second drum housing, each defining a generally cylindrical chamber communicating with the conduit passage;

each drum housing containing a first sprocket element rotatably received in the chamber and having a serrated periphery with each serration adapted to receive an ammunition cartridge;

each drum housing containing a second sprocket element rotatably received in the chamber, and concentric with the first sprocket element, and having a serrated periphery with each serration adapted to receive an ammunition cartridge;

each sprocket element having spaced apart first and second sprocket discs each defining serrations; and each drum housing containing a spring element operably connected to at least one of the sprocket elements, and operable to rotatably bias the sprocket elements to transmit cartridges from the drum chamber to the conduit passage.

9. The magazine of claim 8 wherein each spring is selectably engaged to the sprocket elements, so that the magazine may be loaded without substantial biasing force resisting the loading.

10. The magazine of claim 8 wherein each drum is slightly tapered to define a frustoconical chamber.

11. The magazine of claim 8 wherein one of the discs has a smaller periphery than the other, such that cartridges received in the serrations will define centerlines that converge.

12. The magazine of claim 11 wherein the serrations of each disc are arcs defining centers, the arc centers of each disc being arrayed in a circle having a selected circle diameter, the selected circle diameter for the first disc being larger than the selected diameter of the second disc.

13. The magazine of claim 12 wherein the arcs of the first disc have a smaller radius than the arcs of the second disc.

14. The magazine of claim 8 including an ammunition counter attached to the body and responsive to the passage of each cartridge, and having an indicator indicating the quantity of cartridges passed.

15. The magazine of claim 8 wherein the drums are on opposite sides of the conduit, and the drums have peripheral apertures communicating with the conduit, and wherein the apertures face each other.

16. A detachable magazine for storing and delivering ammunition to a firearm having a magazine well, the magazine comprising:

a body having a column adapted for insertion into the magazine well;

the column defining a passage for transmitting ammunition to the firearm;

the body including a drum housing defining a substantially cylindrical chamber communicating with the column passage;

a first sprocket element rotatably received in the chamber and having a serrated periphery with each serration adapted to receive an ammunition cartridge;

a second sprocket element rotatably received in the chamber, and concentric with the first sprocket element, and having a serrated periphery with each serration adapted to receive an ammunition cartridge;

the serrations configured such that stored cartridges are arranged with their forward tips splayed outward from an axis defined by the sprocket elements; and a spring element operably connected to at least one of the sprocket elements, and operable to rotatably bias the sprocket elements to transmit cartridges from the drum chamber to the column passage.

17. The magazine of claim 16 wherein each sprocket element has spaced apart front and rear sprocket discs each defining serrations, and wherein the forward one of the discs supporting forward portions of each cartridge has a larger periphery than the rear sprocket disc.

18. The magazine of claim 17 wherein the arcs of the forward disc have a smaller radius than the arcs of the second disc.

19. The magazine of claim 16 wherein the serrations define centerlines that converge to a common point to the rear of the magazine.

20. The magazine of claim 16 wherein the serrations of each disc are arcs defining centers, the arc centers of each disc being arrayed in a circle having a selected diameter, the selected diameter for the first disc being smaller than the selected diameter of the second disc.

21. The magazine of claim 16 including a pair of drums on opposite sides of the column.

22. The magazine of claim 21 wherein each drum housing includes rotatable first and second sprocket elements defining an axis of rotation, and wherein the axes of rotation are parallel.

23. The magazine of claim 21 wherein each drum housing includes a forward housing panel and a rear housing panel, and wherein forward housing panels are coplanar.

24. The magazine of claim 21 wherein each drum housing includes a forward housing panel and a rear housing panel, and wherein rear housing panels are coplanar.

25. The magazine of claim 21 wherein each drum housing has a straight cylindrical peripheral sidewall.

* * * * *